US007334908B1

(12) United States Patent
Figueroa

(10) Patent No.: US 7,334,908 B1
(45) Date of Patent: Feb. 26, 2008

(54) PORTABLE BEVERAGE-HOLDING TRAY

(76) Inventor: Hector D. Figueroa, 550 Beach 67TH St., Arverne, NY (US) 11692

( * ) Notice: Subject to any disclaimer, the term of this patent is extended or adjusted under 35 U.S.C. 154(b) by 459 days.

(21) Appl. No.: 10/839,011

(22) Filed: May 6, 2004

(51) Int. Cl.
*F21V 33/00* (2006.01)

(52) U.S. Cl. ..... 362/101

(58) Field of Classification Search ..... 362/101
See application file for complete search history.

(56) References Cited

U.S. PATENT DOCUMENTS

| | | | | |
|---|---|---|---|---|
| 614,565 | A | 11/1898 | Marshall | |
| 1,996,300 | A * | 4/1935 | Lindsay | 294/143 |
| 2,604,579 | A * | 7/1952 | Clement | 362/101 |
| 4,334,623 | A | 6/1982 | Geary | |
| D283,965 | S | 5/1986 | Fitou | |
| 5,769,264 | A | 6/1998 | Lipkowitz | |
| D398,484 | S | 9/1998 | Duggan | |
| 6,283,566 | B1 | 9/2001 | Doces | |
| 2003/0052071 | A1 | 3/2003 | Tremblay | |

* cited by examiner

*Primary Examiner*—Stephen F. Husar
*Assistant Examiner*—James W Cranson, Jr.

(57) ABSTRACT

An apparatus for storing and cooling beverages includes a stand supporting an ice bucket. The bucket includes a rack section provided with notches for supporting beverage vessels. The present invention may further include a light emitting mechanism for illuminating the bucket. Such a light emitting mechanism includes a power supply source, a switch, support rods, and bulbs operably connected to each other. The present invention further includes at least one shelf member engageable with the stand. Such a shelf member includes flange portions spaced apart that are compressible for cooperating with the stand so that it can be maintained at a stable position.

13 Claims, 5 Drawing Sheets

PORTABLE BEVERAGE-HOLDING TRAY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a beverage-holding tray and, more particularly, to a portable beverage-holding tray with an attached ice bucket.

2. Prior Art

Methods for storing stemmed drinking glasses in common use are not entirely satisfactory. The practice is widespread of setting glasses rim down on a shelf, which may not itself be clean.

Numerous rack designs of both the wall-hanging and self-supporting type have been developed for storing and supporting stemmed glassware and wine bottles or beverage containers. One common structure comprises an overhead wine bottle rack with an arrangement of rails or slots for supporting stemmed wine glasses in the inverted position. Another type of stemmed glass storage unit keeps the glasses inverted and the stem and base are held in a circular opening made accessible by a radial slot.

With these type of support structures the common problem is that the inverted stemmed ware is allowed to hang free, subject to possible damaging contact with one another if the support rack is jostled or impacted in any manner. The result, of course, is broken stemmed ware. Additionally, the slotted support arrangements, either the rail type or the radial slot type, provide no means to prevent accidental dislodging of the stemmed glassware if the unit is tilted or jarred.

At parties where food and beverage items are being served, it is difficult for a guest to hold a plate with food and a beverage. Often the only solution is for the guest to use both hands, one holding the plate and the other holding the beverage goblet. With both hands being occupied, the guest must set down one or the other of the plate and goblet to shake hands, open doors, load food items onto the plate or pour a beverage into the goblet. Otherwise a guest must exhibit their dexterity by attempting to hold the plate and goblet in the same hand and use the free hand for the aforementioned tasks. Sometimes attempts at this dexterity leads to spills and other accidents.

Accordingly, a need remains for a portable beverage-holding tray that would safely store and transport a variety of beverage containers to overcome the above-noted shortcomings.

BRIEF SUMMARY OF THE INVENTION

In view of the foregoing background, it is therefore an object of the present invention to provide a portable beverage-holding tray. These and other objects, features, and advantages of the invention are provided by an apparatus for storing and cooling beverages including an elongated stand having a centrally disposed longitudinal axis and an upper end portion spaced outwardly therefrom. Such a stand includes a plurality of support members preferably equally offset from the axis and diverging outwardly at the upper end portion.

Advantageously, the present invention further includes a bucket that has an outer surface secured to the upper end portion of the stand and is positioned substantially centrally about the axis. Such a bucket has an open top portion for selectively receiving ice and beverage bottles therein. The bucket further includes an inner surface spaced from the outer surface for defining a cavity therebetween. In a preferred embodiment, the outer surface further includes a plurality of transparent portions selectively spaced thereabout for providing a line of sight through the bucket.

The bucket further includes a rack section integral with the outer surface and extending radially outwardly therefrom at a substantially orthogonal direction to the axis. The rack section has a plurality of notches spaced about an outer perimeter thereof for supporting a plurality of beverage vessels above a ground surface. Such a plurality of notches each have a substantially arcuate shape, for holding conventionally shaped glass therein.

The present invention further includes a light emitting mechanism for illuminating the bucket that is disposed within the cavity. Such a light emitting mechanism includes a power supply source and a switch electrically coupled thereto that may be toggled between on and off modes. The light emitting mechanism further includes a plurality of support rods and a plurality of bulbs connected thereto. Such a plurality of bulbs are operably connected to the switch and are positionable adjacent the rack section on the outer perimeter of the bucket. Advantageously, the bucket includes a base member threadably attachable to the outer surface for allowing an operator to access the power supply source and the switch supported thereabove.

The present invention further includes at least one shelf member removably engageable with the stand, which is positionable along a select portion thereof. Such a shelf member includes a plurality of resilient flange portions spaced apart and is selectively compressible for cooperating with the plurality of support members so that it can be maintained at a substantially stable position during operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
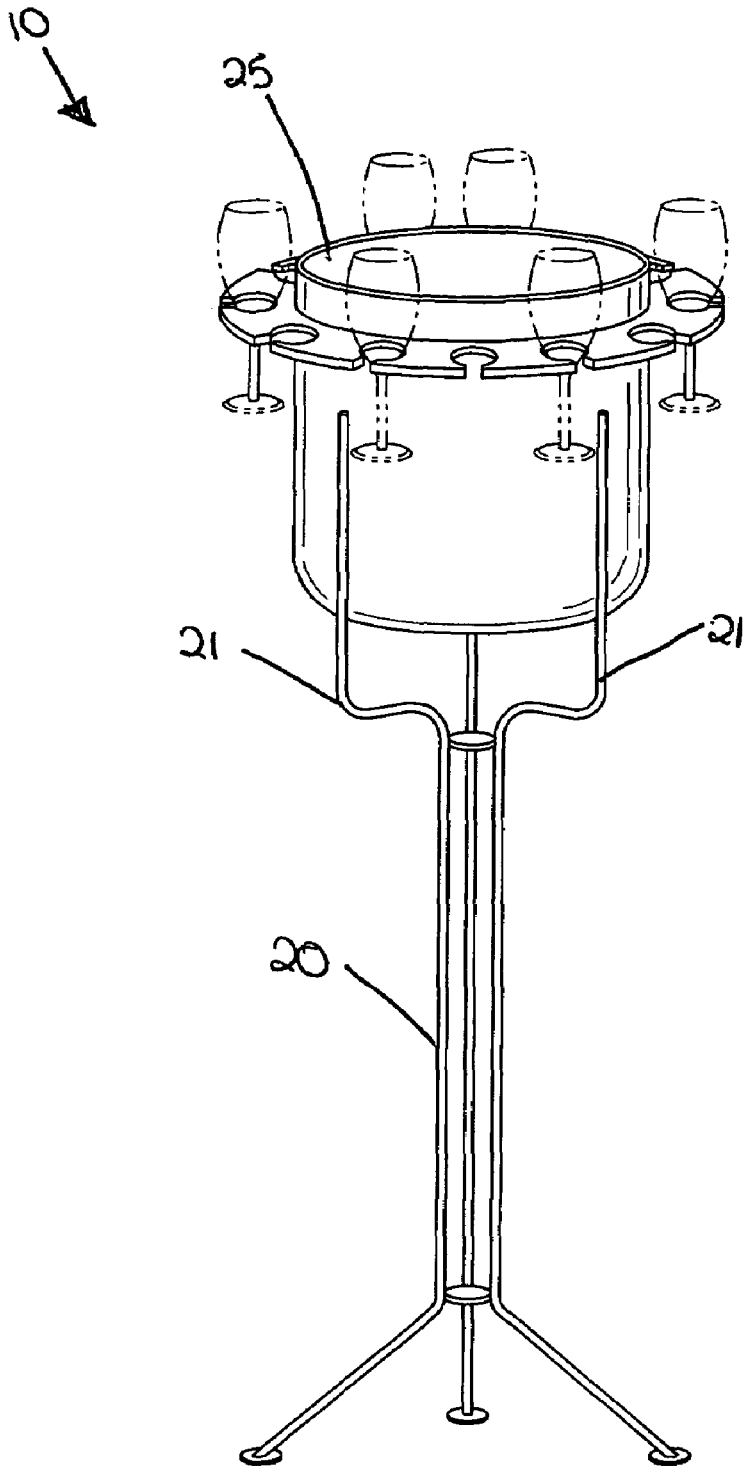
FIG. 1 is a front elevational view showing a portable beverage-holding tray, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures. Prime and double notations refer to alternate embodiments of like elements.

The apparatus of this invention is referred to generally in FIGS. 1-6 by the reference numeral 10 and is intended to provide a portable beverage-holding tray with an attached ice bucket. It should be understood that the apparatus 10 may be employed in residential and business environments and is able to accommodate a variety of beverage containers.

Referring initially to FIG. 1, the apparatus 10 includes an elongated stand 20 having a centrally disposed longitudinal axis and an upper end portion spaced outwardly therefrom. Such a stand 20 includes a plurality of support members 21 preferably equally offset from the axis and diverging outwardly at the upper end portion.

Advantageously, the present invention further includes a bucket 25 that has an outer surface secured to the upper end portion of the stand 20 and is positioned substantially centrally about the axis. Such a bucket 25 has an open top portion for selectively receiving ice and beverage bottles therein. The bucket 25 further includes an inner surface spaced from the outer surface for defining a cavity therebetween. In an alternate embodiment 10', the outer surface further includes a plurality of transparent portions 26 selectively spaced thereabout for providing a line of sight through the bucket 25', best shown in FIG. 4.

Figure 2:
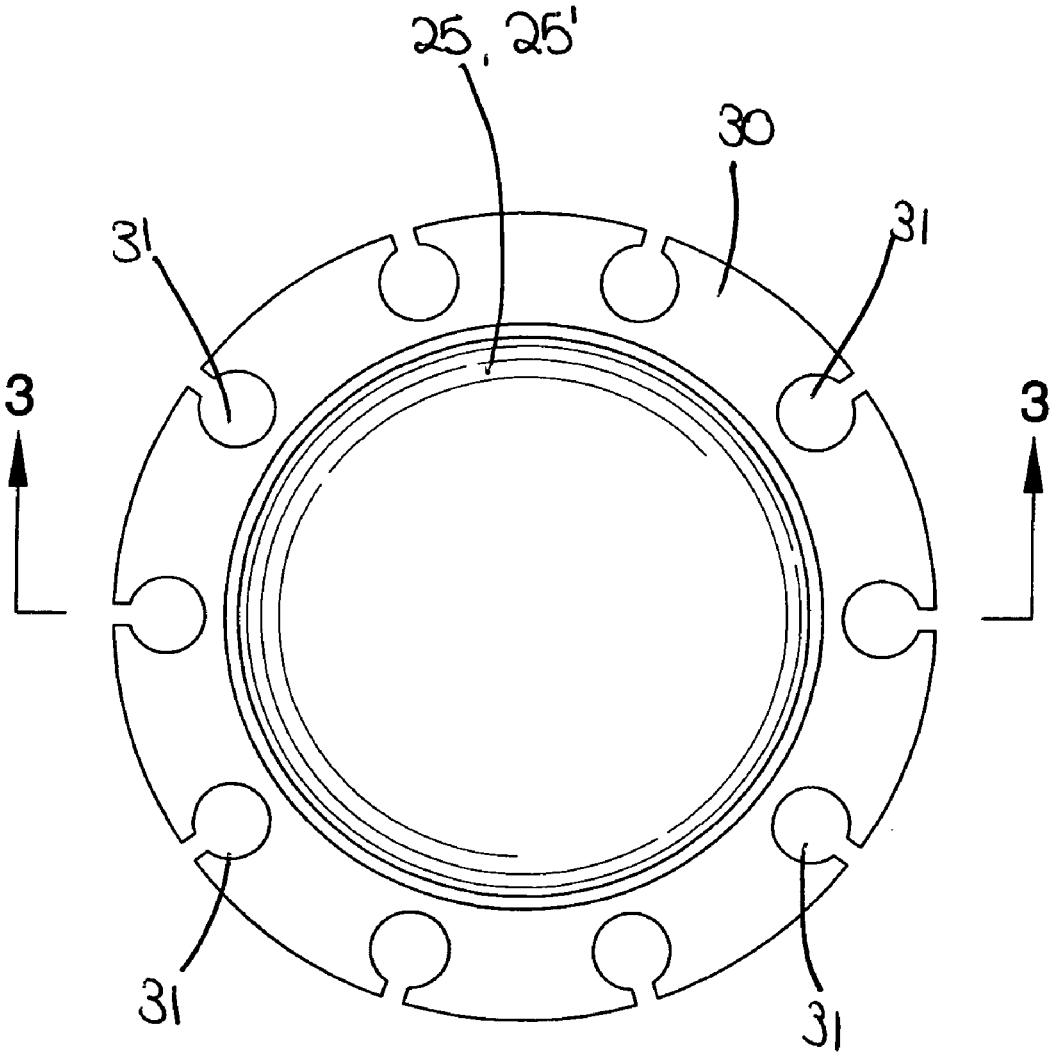
FIG. 2 is an enlarged top plan view of the present invention shown in FIG. 1.
Figure 3:
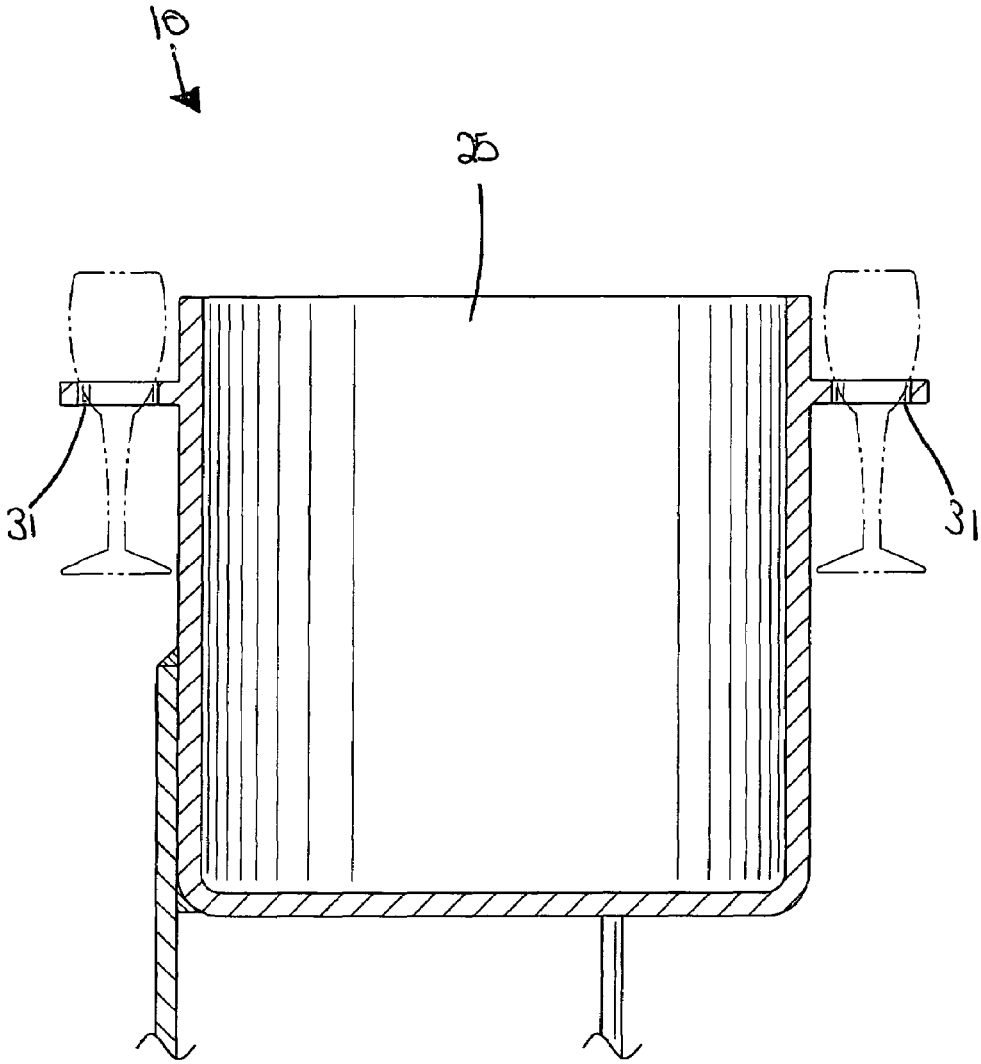
FIG. 3 is an enlarged cross-sectional view of the present invention shown in FIG. 2 taken along line 3-3.

Referring to FIGS. 2 and 3, embodiments 25, 25' further includes a rack section 30 integral with the outer surface and extending radially outwardly therefrom at a substantially orthogonal direction to the axis. The rack section 30 has a plurality of notches 31 spaced about an outer perimeter thereof for supporting a plurality of beverage vessels above a ground surface. Such a plurality of notches 31 each have a substantially arcuate shape, for holding conventionally shaped glass therein. Advantageously, the rack section 30 is able to accommodate beer mugs, champagne glasses, wine glasses and soft drink containers, for example.

Figure 4:
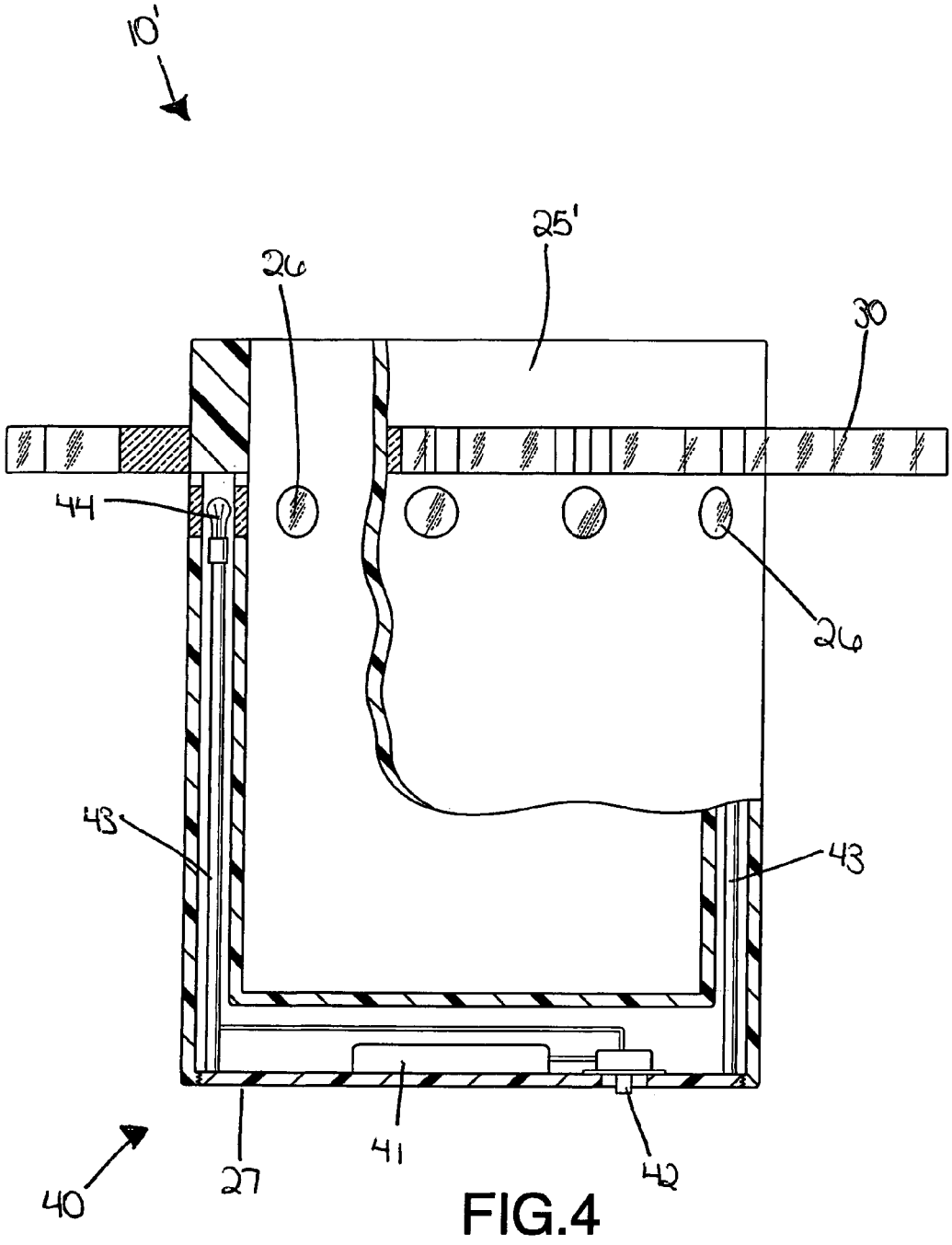
FIG. 4 is an enlarged cross-sectional view showing an alternate embodiment of the present invention, which includes a light emitting mechanism.

Referring to FIG. 4, an alternate embodiment 10' further includes a light emitting mechanism 40 for illuminating the bucket 25' that is disposed within the cavity. Such a light emitting mechanism 40 includes a power supply source 41 and a switch 42 electrically coupled thereto that may be toggled between on and off modes. The light emitting mechanism 40 further includes a plurality of support rods 43 and a plurality of bulbs 44 connected thereto. Such a plurality of bulbs 44 are operably connected to the switch 42 and are positionable adjacent the rack section 30 on the outer perimeter of the bucket 25'. Advantageously, the bucket 25' includes a base member 27 threadably attachable to the outer surface for allowing an operator to access the power supply source 41 and the switch 42 supported thereabove.

Figure 5:
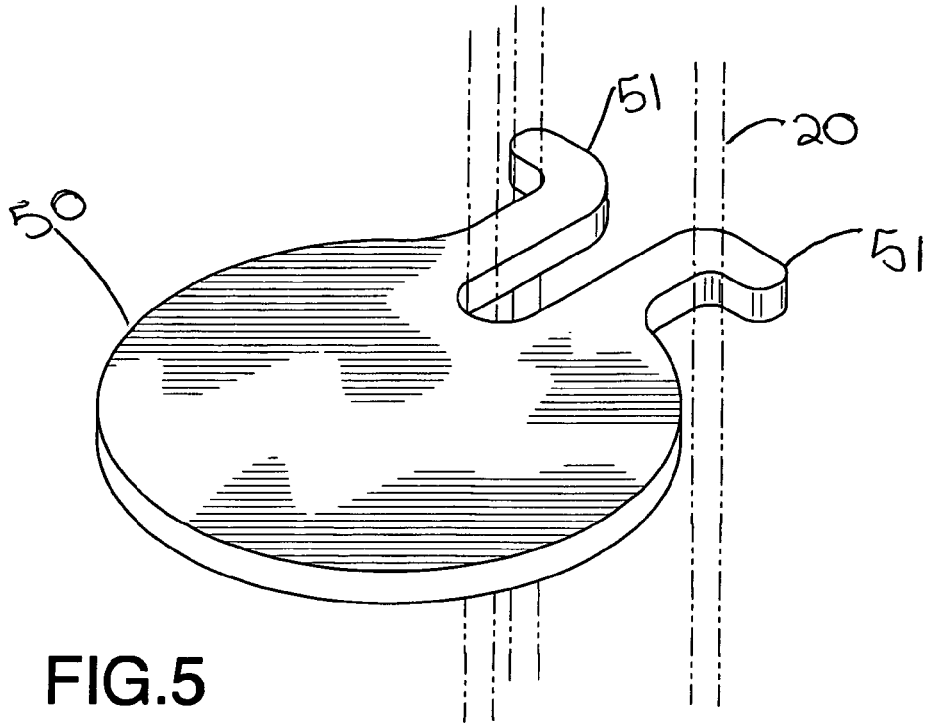
FIG. 5 is an enlarged perspective view showing a shelf member removably attachable to the stand.
Figure 6:
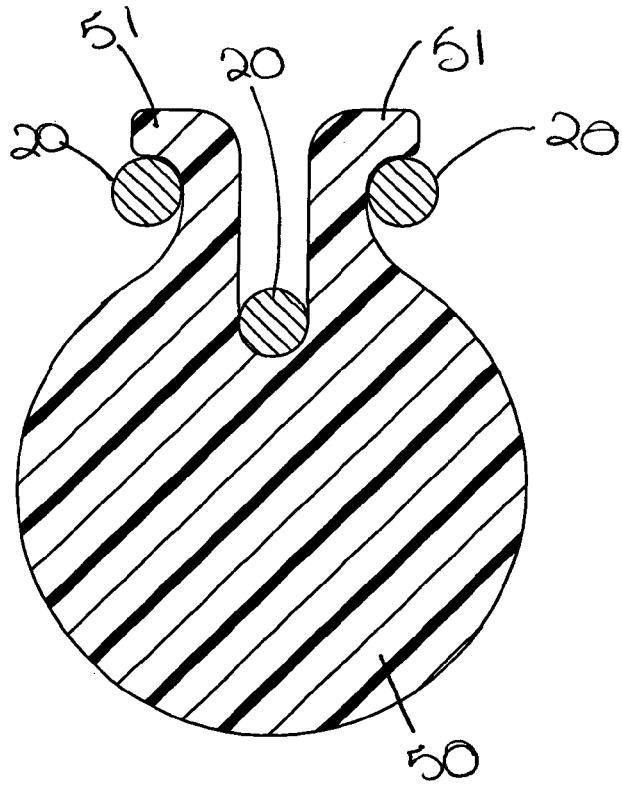
FIG. 6 is a cross-sectional view of the shelf member shown in FIG. 5.

Referring to FIGS. 5 and 6, the present invention further includes at least one shelf member 50 removably engageable with the stand 20, which is positionable along a select portion thereof. Such a shelf member 50 includes a plurality of resilient flange portions 51 spaced apart and is selectively compressible for cooperating with the plurality of support members 50 so that it can be maintained at a substantially stable position during operating conditions.

The present invention offers an attractive way to hold and transport beverage containers as well as ice. Those who work in the food service industry may find the present invention to be very handy when serving patrons. People who frequently host parties in their home will enjoy this all-in-one unit because it is neat and limits spills that often occur during a crowded party.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for storing and cooling beverages, said apparatus comprising:

an elongated stand having a centrally disposed longitudinal axis and an upper end portion spaced outwardly therefrom, said stand including a plurality of support members equally offset from the axis and diverging outwardly at said upper end portion; and a bucket having an outer surface secured to said upper end portion of said stand and being positioned substantially centrally about the axis, said bucket having an open top portion for selectively receiving ice and beverage bottles therein, said bucket comprising a rack section integral with said outer surface and extending radially outwardly therefrom at a substantially orthogonal direction to the axis, said rack section having a plurality of notches spaced about an outer perimeter thereof and for supporting a plurality of beverage vessels above a ground surface;

further comprising: at least one shelf member removably engageable with said stand and being positionable along a select portion thereof, said at least one shelf member including a plurality of resilient flange portions spaced apart and being selectively compressible for cooperating with said plurality of support members so that said at least one shelf member can be maintained at a substantially stable position during operating conditions.

2. The apparatus of claim 1, wherein said bucket further comprises:

an inner surface spaced from said outer surface and for defining a cavity therebetween; and light emitting means for illuminating said bucket and disposed within the cavity, said light emitting means comprising a power supply source and a switch electrically coupled thereto, said switch for being toggled between on and off modes, and a plurality of support rods and a plurality of bulbs connected thereto, said plurality of bulbs being operably connected to said switch and being positionable adjacent said rack section the outer perimeter of said bucket.

3. The apparatus of claim 1, wherein said outer surface comprises: a plurality of transparent portions selectively spaced thereabout and for providing a line of sight through said bucket.

4. The apparatus of claim 1, wherein the plurality of notches each have a substantially arcuate shape.

5. The apparatus of claim 2, wherein said bucket further comprises: a base member threadably attachable to said outer surface and for allowing an operator to access said power supply source and said switch supported thereabove.

6. An apparatus for storing and cooling beverages, said apparatus comprising:

an elongated stand having a centrally disposed longitudinal axis and an upper end portion spaced outwardly therefrom, said stand including a plurality of support members equally offset from the axis and diverging outwardly at said upper end portion; and a bucket having an outer surface secured to said upper end portion of said stand and being positioned substantially centrally about the axis, said bucket further having an inner surface spaced from said outer surface and for defining a cavity therebetween, said bucket further having an open top portion for selectively receiving ice and beverage bottles therein, said bucket comprising a rack section integral with said outer surface and extending radially outwardly therefrom at a substantially orthogonal direction to the axis, said rack section having a plurality of notches spaced about an outer perimeter thereof and for supporting a plurality of beverage vessels above a ground surface; and light emitting means for illuminating said bucket and disposed within the cavity, said light emitting means comprising a power supply source and a switch electrically coupled thereto, said switch for being toggled between on and off modes, and a plurality of support rods and a plurality of bulbs connected thereto, said plurality of bulbs being operably connected to said switch and being positionable adjacent said rack section the outer perimeter of said bucket;

further comprising: at least one shelf member removably engageable with said stand and being positionable along a select portion thereof, said at least one shelf member including a plurality of resilient flange portions spaced apart and being selectively compressible for cooperating with said plurality of support members so that said at least one shelf member can be maintained at a substantially stable position during operating conditions.

7. The apparatus of claim 6, wherein said outer surface comprises: a plurality of transparent portions selectively spaced thereabout and for providing a line of sight through said bucket.

8. The apparatus of claim 6, wherein the plurality of notches each have a substantially arcuate shape.

9. The apparatus of claim 6, wherein said bucket further comprises: a base member threadably attachable to said outer surface and for allowing an operator to access said power supply source and said switch supported thereabove.

10. An apparatus for storing and cooling beverages, said apparatus comprising:

an elongated stand having a centrally disposed longitudinal axis and an upper end portion spaced outwardly therefrom, said stand including a plurality of support members equally offset from the axis and diverging outwardly at said upper end portion; and a bucket having an outer surface secured to said upper end portion of said stand and being positioned substantially centrally about the axis, said bucket further having an inner surface spaced from said outer surface and for defining a cavity therebetween, said bucket further having an open top portion for selectively receiving ice and beverage bottles therein, said bucket comprising a rack section integral with said outer surface and extending radially outwardly therefrom at a substantially orthogonal direction to the axis, said rack section having a plurality of notches spaced about an outer perimeter thereof and for supporting a plurality of beverage vessels above a ground surface;

light emitting means for illuminating said bucket and disposed within the cavity, said light emitting means comprising a power supply source and a switch electrically coupled thereto, said switch for being toggled between on and off modes, and a plurality of support rods and a plurality of bulbs connected thereto, said plurality of bulbs being operably connected to said switch and being positionable adjacent said rack section the outer perimeter of said bucket; and at least one shelf member removably engageable with said stand and being positionable along a select portion thereof, said at least one shelf member including a plurality of resilient flange portions spaced apart and being selectively compressible for cooperating with said plurality of support members so that said at least one shelf member can be maintained at a substantially stable position during operating conditions.

11. The apparatus of claim 10, wherein said outer surface comprises: a plurality of transparent portions selectively spaced thereabout and for providing a line of sight through said bucket.

12. The apparatus of claim 10, wherein the plurality of notches each have a substantially arcuate shape.

13. The apparatus of claim 10, wherein said bucket further comprises: a base member threadably attachable to said outer surface and for allowing an operator to access said power supply source and said switch supported thereabove.

* * * * *